US008608595B2

(12) United States Patent
Ikka et al.

(10) Patent No.: US 8,608,595 B2
(45) Date of Patent: Dec. 17, 2013

(54) IMAGE-CAPTURING APPARATUS FOR PUTTING PRACTICE AND TRAINING PUTTER HAVING IMAGE-CAPTURING APPARATUS

(75) Inventors: Akinari Ikka, Tokyo (JP); Akira Mori, Osaka (JP)

(73) Assignee: Mugen Inc. (JP)

( * ) Notice: Subject to any disclaimer, the term of this patent is extended or adjusted under 35 U.S.C. 154(b) by 0 days.

(21) Appl. No.: 13/314,485

(22) Filed: Dec. 8, 2011

(65) Prior Publication Data

US 2012/0184398 A1 Jul. 19, 2012

(30) Foreign Application Priority Data

Jun. 1, 2009 (JP) ..... 2009-148086

(51) Int. Cl.
*A63B 69/36* (2006.01)

(52) U.S. Cl.
USPC ..... 473/407; 473/219; 473/257

(58) Field of Classification Search
USPC ..... 473/209, 219, 226, 231, 238, 240, 241, 473/242, 251, 257, 267, 268, 407
See application file for complete search history.

(56) References Cited

U.S. PATENT DOCUMENTS

| | | | | |
|---|---|---|---|---|
| 4,053,160 | A * | 10/1977 | Salata | 473/240 |
| 4,137,566 | A * | 1/1979 | Haas et al. | 473/209 |
| 5,509,657 | A * | 4/1996 | Guthry | 473/241 |
| 5,842,932 | A * | 12/1998 | Goddard | 473/240 |
| 7,252,596 | B1 * | 8/2007 | Matousek | 473/226 |
| 7,857,708 | B2 * | 12/2010 | Ueda et al. | 473/257 |
| 7,887,430 | B1 * | 2/2011 | Henley, Jr. | 473/240 |
| 2005/0261071 | A1 * | 11/2005 | Cameron | 473/219 |

FOREIGN PATENT DOCUMENTS

| | | | |
|---|---|---|---|
| JP | 01-214378 | A | 8/1989 |
| JP | 06-000237 | A | 1/1994 |
| JP | 6-105940 | A | 4/1994 |
| JP | 6-182013 | A | 7/1994 |
| JP | 8-196674 | A | 8/1996 |
| JP | 08-299524 | A | 11/1996 |
| JP | 11-244441 | A | 9/1999 |
| JP | 2000-197721 | A | 7/2000 |
| JP | 2004-081407 | A | 3/2004 |
| JP | 2005-237396 | A | 9/2005 |
| JP | 2006-329967 | A | 12/2006 |

(Continued)

OTHER PUBLICATIONS

Brochure produced by Infinics-Japan Co., Ltd, 2007; with Partial English Translation.
"Guide to Computer-aided Image Processing"; compiled under the supervision of Hideyuki Tamura (Sohken Publishing Co., Ltd., 1985) pp. 110-113; with partial English Translation.

(Continued)

*Primary Examiner* — Nini Legesse
(74) *Attorney, Agent, or Firm* — Cantor Colburn LLP

(57) ABSTRACT

An image-capturing apparatus for putting practice which is mounted on a putter provided with a head including a face for putting, a shaft, and a grip includes: an image-capturing unit provided with a camera for imaging a hole; a computation unit configured to specify a face perpendicular line which is a vertical line drawn from the center of the face, and calculate a relative relation between the hole and the face perpendicular line based on a hole image captured by the camera; a display unit configured to display the relative relation calculated by the computation unit; and a mounting unit configured to mount at least the image-capturing unit on the shaft or the grip.

14 Claims, 10 Drawing Sheets

(56) References Cited

FOREIGN PATENT DOCUMENTS

| | | | |
|---|---|---|---|
| JP | 2007-000559 | A | 1/2007 |
| JP | 3132762 | U | 6/2007 |
| JP | 2008-073210 | A | 3/2008 |
| JP | 2008-104501 | A | 5/2008 |
| JP | 2009-148086 | A | 7/2009 |
| WO | 9745176 | A1 | 12/1997 |
| WO | 2009044867 | A1 | 4/2009 |

OTHER PUBLICATIONS

"Guide to Digital Image Processing" written by Koichi Sakai (CQ Publishing Co., Ltd., Oct. 1, 2002) pp. 63-68; with partial English translation.

Takeshi Agui et al., "Image Processing and Recognition"; Shoko-do Co., Ltd., 1992, pp. 140-157; with partial English Translation.

Japanese Office Action, Notice of Reasons for Rejection for Japanese patent application No. 2009-148086; mailing date of Mar. 19, 2013; with English translation.

* cited by examiner

IMAGE-CAPTURING APPARATUS FOR PUTTING PRACTICE AND TRAINING PUTTER HAVING IMAGE-CAPTURING APPARATUS

BACKGROUND OF INVENTION

1. Field of the Invention

The present invention relates to an image-capturing apparatus for putting practice and a training putter having an image-capturing apparatus. Particularly, the present invention relates to deviation correction between a direction of a hole (also referred to as a cup) and a direction of a putter face and to display the distance, the direction, and the inclination to the hole.

2. Description of Related Art

Conventionally, in relation to a golf training putter, mounting an LED or a laser light source on a head has been proposed. Japanese Unexamined Patent Application, First Publication No. H06-182013 (Patent Document 1) discloses a means for directing laser light from a laser light source mounted on a head to a target. This is contrived so as to be detachable and attachable with respect to the head.

An outline of Japanese Unexamined Patent Application, First Publication No. H08-196674 (Patent Document 2) can also be regarded as the same proposal as that by Patent Document 1 other than that a laser light source is provided in a shaft at a position which is the closest to a head.

In addition, a putter manufactured by Infinics-Japan Co., Ltd has been displayed at an exhibition in a golf show (brochure produced by Infinics-Japan Co., Ltd., Non-Patent Document 1), which was a putter with a gyroscope and was disadvantageous in that it was not possible to know the distance up to a hole and the direction to the hole while it was possible to know the swing locus and the impact position.

However, they have the following disadvantages. As external equipment is out of the question, the idea of attaching to the putter would at first glance seem good; however, the undulation is intentionally created in the green, and it is generally difficult to view the hole from a position (height) near a putter head. The view point of a player and the view point from the head and the vicinity of the head are completely different.

In addition, there is a disadvantage in that it is difficult to see laser light in daytime. Moreover, there is a disadvantage in that a component for laser light further bothers the player as the component is located at a further position from a grip and a closer position from the head due to the weight thereof. In addition, even a putter is used for a strong shot in some cases and receives strong impact, and components are easily broken. The head portion is easily contaminated with soil and grass.

According to Japanese Unexamined Patent Application, First Publication No. 2008-104501 (Patent Document 3), attempt to make it possible to microscopically view how a ball is hit by providing a camera at least at the head has been proposed.

In the proposal in Patent Document 3, how to hit a ball into the hole, namely "the future" is not included, and "the past" is displayed to be microscopically viewed. Moreover, providing a plurality of cameras at the head to enhance information accuracy of an image is also described. This is also about an image in the past and does not give guidance "for the future" (the direction of the face to be set for a shot).

Furthermore, since the camera is provided at the head, there is a disadvantage in that the weight of the head is increased, feeling at the time of hitting a ball is changed, and directional accuracy is also degraded due to torsion. There is a defect in that the weight of the camera has more influence as the camera is located at a position farther from the grip portion. The field of view of the camera is narrow at the head position which is the closest to the ground, and only limited information is obtained. Moreover, a camera lens is easily contaminated.

According to Japanese Unexamined Patent Application, First Publication No. H06-105940 (Patent Document 4), external equipment instead of a club (putter) has been contrived in order to determine the strength and direction of a shot, and further, the equipment is complicated and large-scale equipment with which a robot is made to hit a ball for correction based on comparison with a person who practices. This external equipment is disadvantageous in that the equipment is fixed type equipment and requires massive numbers of devices, and the camera is just a part of the external equipment. That is, although there is no device to be provided in the putter, only the way to hit a ball corresponding to specific external equipment can be taught.

Japanese Unexamined Patent Application, First Publication No. H11-244441 (Patent Document 5) also proposes a putter training machine, which is a proposal of external equipment on the assumption that it is possible to correct bad habits in a shot by placing an external cameral in addition to an artificial slope and viewing an after-the-fact ball locus image.

In addition, in experiments with the use of a commercially available laser pointer, it has been determined to be impractical since locus of light which irradiates the grass and the hole cannot be seen due to its excessive low position.

SUMMARY OF THE INVENTION

An object of the present invention is to provide an image-capturing apparatus for putting practice and a training putter having an image-capturing apparatus without the above disadvantages.

In order to solve the above problems, there is provided an image-capturing apparatus for putting practice which is mounted on a putter provided with a head including a face for putting, a shaft, and a grip, the image-capturing apparatus including: an image capturing unit provided with a camera for imaging a hole; a computation unit configured to specify a face perpendicular line which is a vertical line drawn from the center of the face, and calculate a relative relation between the hole and the face perpendicular line based on a hole image captured by the camera; a display unit configured to display the relative relation calculated by the computation unit; and a mounting unit configured to mount at least the image-capturing unit on the shaft or the grip.

By mounting the image-capturing unit at a high position such as in the shaft or the grip, imaging the hole becomes easier even if there is inclination in the green, and there is also an advantage in that the camera is less contaminated.

According to the image-capturing apparatus for putting practice, the display unit may be provided with a display configured to simultaneously display the hole and the face perpendicular line.

According to the image-capturing apparatus for putting practice, the display unit may be provided with a plurality of lamps which are turned on in accordance with a deviation amount between the hole and the face perpendicular line.

According to the image-capturing apparatus for putting practice, the computation unit may calculate a distance from the face to the hole based on the longer diameter of the hole image, and the display unit may display the distance. In a golf game, a hole inner diameter is set to 10.8 cm, a maximum diameter (longest diameter) corresponds to the diameter of 10.8 cm even if the hole looks like an ellipse in various manners due to the inclination, and therefore, it is possible to measure the distance even with a single camera.

According to the image-capturing apparatus for putting practice, the image-capturing unit may be provided with a second camera configured to capture the hole, the computation unit may calculate the distance from the face to the hole based on a disparity between two hole images captured by the camera and the second camera, and the display unit may display the distance. The distance between the camera and the second camera, for the sake of precision is preferably as long as possible, within a range with which the cameras do not bother the player, and the distance particularly preferably ranges from 3 cm to 20 cm.

According to the image-capturing apparatus for putting practice, the image-capturing unit may be provided with a downward-pointing camera configured to capture the feet of a person who practices, the computation unit may specify a stance direction of the person who practices based on an image captured by the down-pointing camera, and the display unit may display the stance direction as well as the relative relation.

According to the image-capturing apparatus for putting practice, the computation unit may calculate an angle between a straight line connecting the hole and the center of the head and the face perpendicular line, and the display unit may display the angle.

The image-capturing apparatus for putting practice may further include: a distance sensor configured to measure the distance from the face to the hole; and an inclination sensor configured to measure the inclination of the putter, and the computation unit may calculate a to-horizontal-surface angle between a straight line connecting the hole and the center of the head and the horizontal axis based on measurement results by the distance sensor and the inclination sensor.

According to the image-capturing apparatus for putting practice, the display unit may display the to-horizontal-surface angle.

According to the image-capturing apparatus for putting practice, the computation unit may calculate a putting guideline from the face to the hole based on the angle, and the display unit may display the putting guideline with the face.

The image-capturing apparatus for putting practice may further include: a geomagnetic sensor configured to measure an orientation; and an inclination sensor configured to measure the inclination of the putter, the computation unit may calculate undulation from the face to the hole based on the plurality of hole images captured while the grip is moved from front to back and from side to side or rotated around the shaft in a state in which the head is grounded, and the display unit may display the undulation.

The image-capturing apparatus for putting practice may further include a shot sensor configured to detect a hit by the face, the computation unit may calculate a relative relation between the hole and the face perpendicular line at the time of the shot detected by the shot sensor, and the display unit may display the relative relation at the time of the shot calculated by the computation unit.

The image-capturing apparatus for putting practice may further include a notification unit configured to generate sound or vibration in accordance with the relative relation calculated by the computation unit. For example, it is possible to consider notification with music, a musical scale, sound, buzz, or the like or notification by generating vibration, when the face perpendicular line and the hole coincides with each other or notification with sound or a musical scale when the face perpendicular line approaches the hole.

The present invention further provides a training putter having any one of the above image-capturing apparatuses for putting practice.

According to the training putter, the image-capturing unit is preferably mounted at a position, which is closer to the grip than an intermediate point between the head and the grip, in the shaft. By mounting the image-capturing unit at a position, which is closer to the grip than the intermediate point between the head and the grip, in the shaft, there is an advantage that imaging of the hole becomes easier even if there is inclination in the green, and that the camera is prevented from getting dirt.

BRIEF DESCRIPTION OF THE DRAWINGS

FIG. 3 is a diagram showing an image-capturing unit (camera), a computation unit (CPU), and the like.

DETAILED DESCRIPTION OF THE INVENTION

Figure 1:
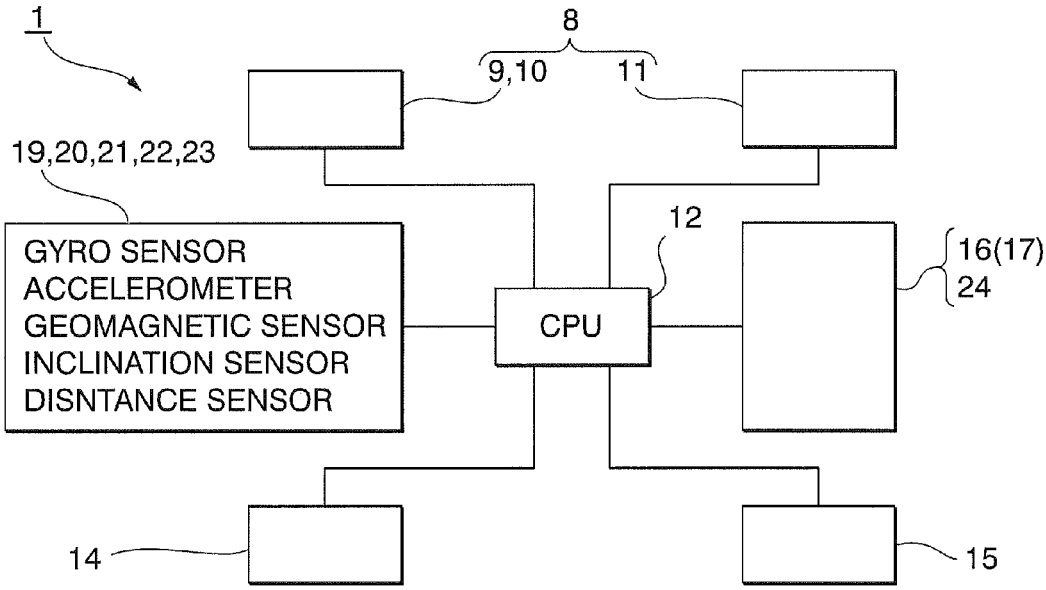
FIG. 1 is a configuration diagram of an image-capturing apparatus for putting practice obtained by the invention of this application.
Figure 2:
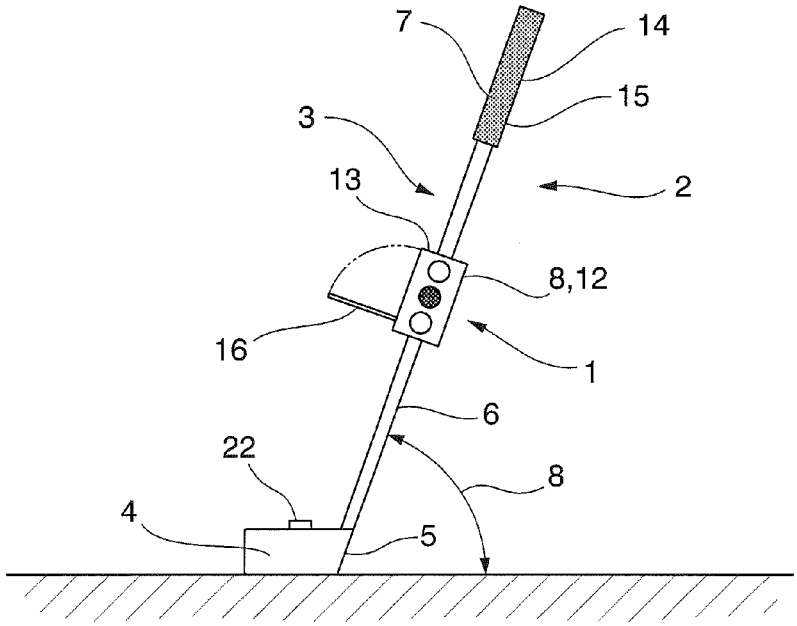
FIG. 2 is an overall diagram of a training putter obtained by the invention of this application.
Figure 3:
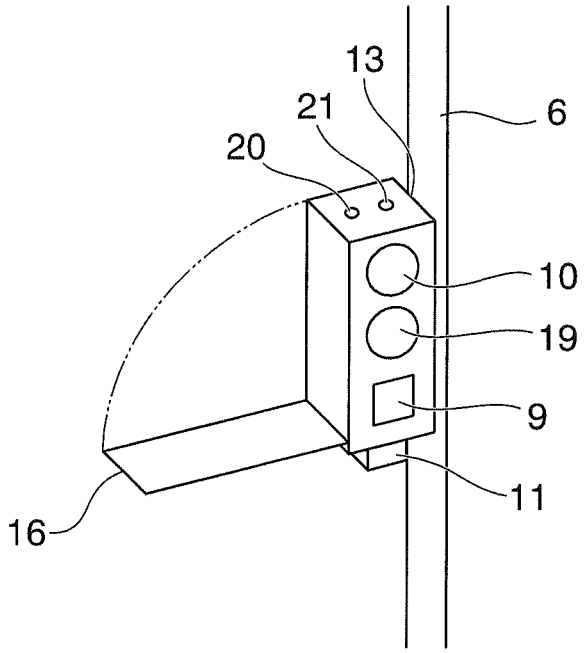

Next, description will be given of embodiments of the present invention with reference to the drawings. FIGS. 1, 2, and 3 are diagrams illustrating configurations of an image-capturing apparatus 1 for putting practice, and a training putter 2. The image-capturing apparatus 1 for putting practice is mounted on a putter 3 provided with a putter head 5 including a face 4 for a shot (putting), a shaft 6, and a grip 7 via a mounting portion 13 to configure a training putter 2. The image-capturing apparatus 1 for putting practice is provided with an image-capturing unit 8, a liquid crystal display 16 (display unit), various sensors (a distance sensor 19, an inclination sensor 20, a geomagnetic sensor 21, an accelerometer 22 (shot sensor), a gyro sensor 23), a first switch 14 and a second switch 15 with which the power is turned on and off and a display is switched, and a CPU 12 (computation unit) connected to each of the various devices. The image-capturing unit 8 is provided with a first camera 9 and a second camera 10 for imaging a hole and a third camera 11 (downward-pointing camera). The CPU 12 receives an electric signal from each camera and an electric signal from each sensor to perform various kinds of computation and display control for the liquid crystal display 16. Although the mounting portion 13 is preferably configured to be detachable with a bolt, a nut, or the like, it is also possible to fix the image-capturing apparatus 1 for putting practice to the putter 3 with a bonding means such as adhesive or the like. In FIG. 2, a reference numeral 6 represents a lie angle of the putter 3. The accelerometer 22 is preferably attached to the putter head 5 in order to detect a moment of impact (putting).

Although two cameras (the first camera 9 and the second camera 10) are mounted in order to image the hole in this embodiment, one of the first camera 9 and the second camera 10 may be omitted since the distance up to the hole can be imaged with a single camera as will be described later. In addition, it is also possible to omit the distance sensor 19 for the same reason. The inclination sensor 20 is used to measure the leaning of the putter 3 or the inclination between the putter head 5 and the hole.

The liquid crystal display 16 is a folded type in this embodiment, a direction thereof is set so as to be seen by a person who practices, and it is possible to protect the liquid crystal screen by folding when carried. In addition, a liquid crystal display is exemplified here, an organic EL display or another type display may also be used.

FIG. 3 is a diagram showing an image-capturing unit 8, a CPU 12, a liquid crystal display 16, and various sensors. Here, image sensors manufactured by Alps Electric Co., Ltd. (camera module) (product number: FPDJ8, size: 1.496 mm×1.056 mm, number of pixels: 640×480) were used as the first camera 9, the second camera 10, and the third camera 11. The reference numeral 19 represents the distance sensor, the reference numeral 20 represents the inclination sensor, and the reference numeral 21 represents the geomagnetic sensor. They may be arranged inside the shaft 6. Moreover, the gyro sensor 23 may also be provided at the same time.

Figure 4:
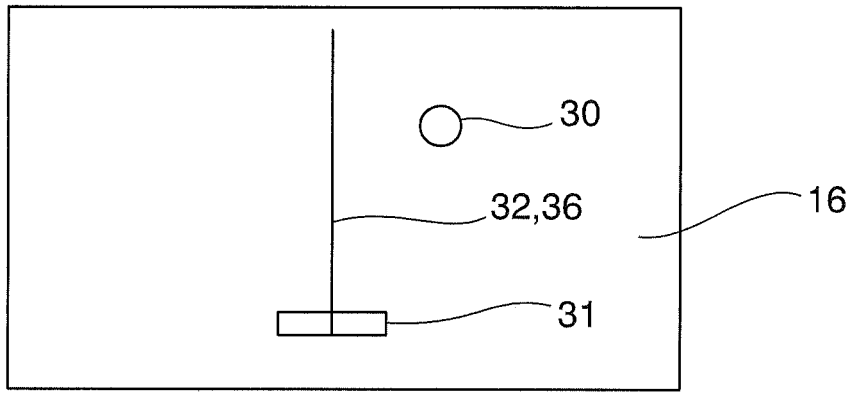
FIG. 4 is a diagram of a guideline display by a display unit, which particularly shows a case in which a hole and the guideline do not coincide with each other.

FIG. 4 is a diagram, in which a guideline 36 (putting guideline) is displayed with a putter head image 31 in the liquid crystal display 16, which particularly shows a case in which the hole image 30 and the guideline 36 do not coincide with each other. In such a case, the guideline 36 coincides with a face perpendicular line 32 which is a vertical line drawn from a center of the face 4. Turning ON and OFF of the guideline 36 is performed with the first switch 15. If the guideline 36 is matched to the hole image 30, the face 4 of the training putter 2 is directed to a correct putting direction. When the hole image 30 is on the guideline 36, the liquid crystal display 16 displays the distance up to the hole, which has been calculated by the CPU 12. However, if the hole image 30 is not on the guideline 36, it is possible to display the distance up to the hole.

Figure 5:
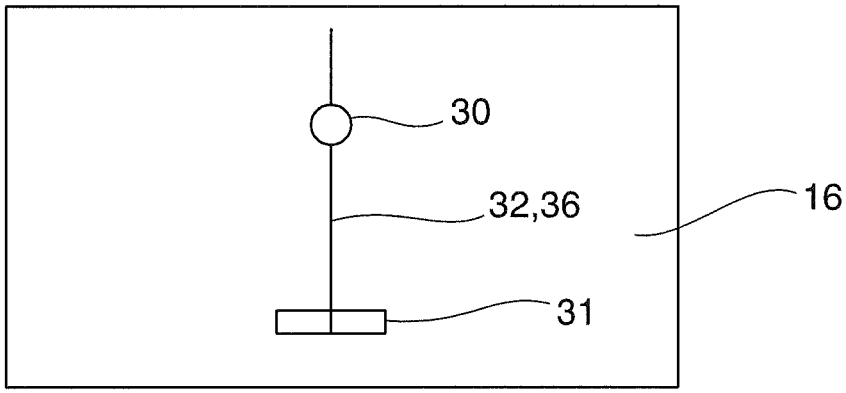
FIG. 5 is a diagram of a guideline display by a display unit, which particularly shows a case in which a hole and the guideline coincide with each other.

FIG. 5 is a diagram, in which the guideline 36 is displayed with the putter head image 31 on the liquid crystal display 16, which particularly shows a case in which the hole image 30 and the guideline 36 coincide with each other.

Figure 6:
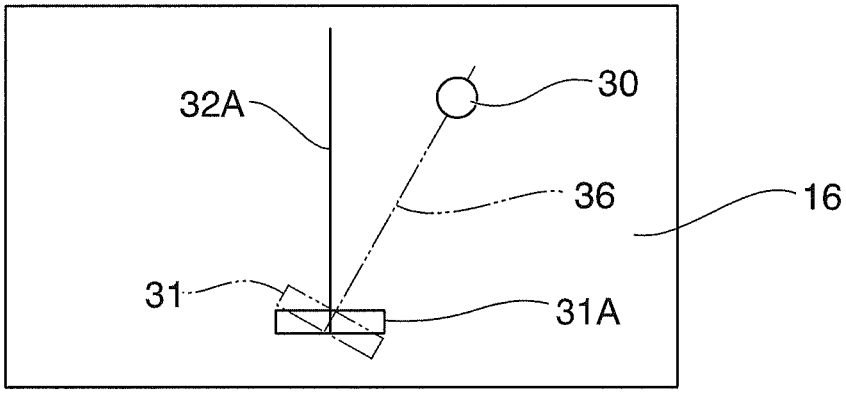
FIG. 6 shows variance between a putter head angle and a ball position at the time of impact, which is shown by the display unit.

FIG. 6 shows a deviation in a direction of the putter head 5 at the time of impact (at the time of putting) in the liquid crystal display 16. A reference numeral 31 represents a putter head image before putting, a reference numeral 31A represents a putter head image at the time of putting, a reference numeral 36 represents a guideline before putting, and a reference numeral 32A represents a face perpendicular line at the time of putting. It can be seen in the display that the putter head 5 was rotated at the time of putting and putting could not be performed as was intended although the hole image 30 and the guideline 36 coincided with each other before putting. If practice is repeated so as not to generate the rotation of the putter head 5 with reference to the display, it is possible to enhance precision in putting.

Figure 7:
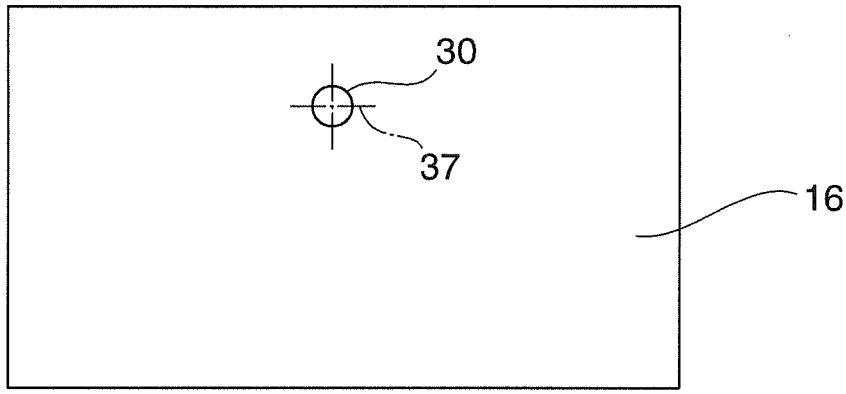
FIG. 7 is a diagram showing a reference line to be supplementarily used to realize precise distance measurement.

FIG. 7 shows a reference line (marker) 37 which is supplementarily used in order to realize precise distance measurement. By matching the hole image 30 with the reference line 37, it is possible to enhance precision in measurement of the distance up to the hole.

Figure 8:
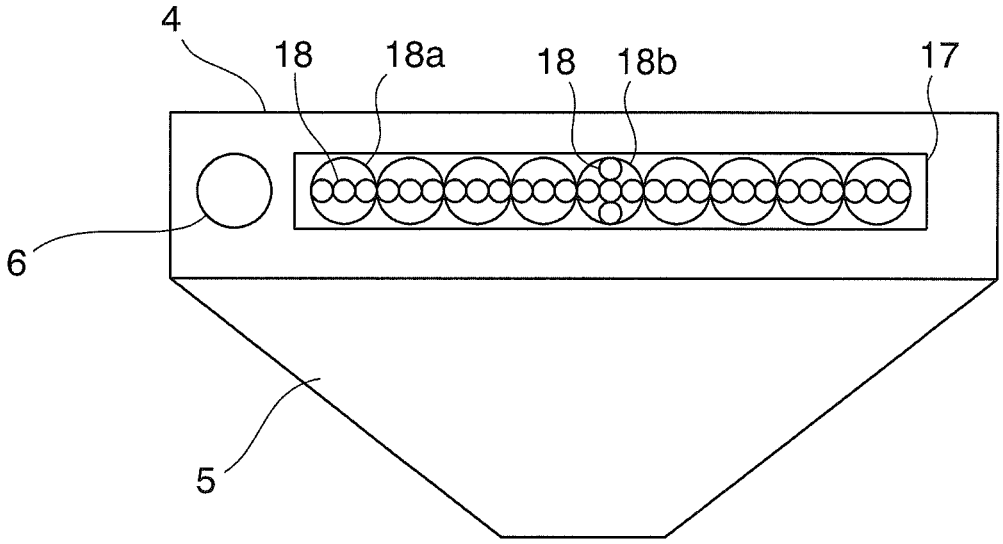
FIG. 8 is an example of a lamp type display device showing a deviation in a direction of a putter head with respect to a hole with a turning-on state of lamps.

FIG. 8 shows a mode in which a lamp type display device 17 is used instead of the liquid crystal display 16 as the display unit. A lamp type display device 17 displays a degree of coincidence or a degree of divergence between a straight line connecting the hole position and the putter head position and the face perpendicular line 32 (which is not displayed) by a turning-on state of a plurality of display lamps 18 (shown as small circles in the drawing). Reference numerals 18*a* and 18*b* represents circular drawings (shown by large circles in the drawing) corresponding to one cup. One display lamp 18 corresponds to divergence of ⅓ cups. When the straight line connecting the hole position and the putter head position and the face perpendicular line 32 coincide with each other (when targeting is correctly performed in the putting), three display lamps 18 arranged in a direction perpendicular to the face 4 in the circular drawings 18 at the center are turned on (or may be turned on particularly brightly), and the display lamp 18 distant away from the circular drawing 18*b* is turned on in accordance with the degree of divergence between the straight line connecting the hole position and the putter head position and the face perpendicular line 32. The display lamps 18 may be turned on one by one, or a plurality of display lamps 18 may be turned on at the same time.

Figure 9:
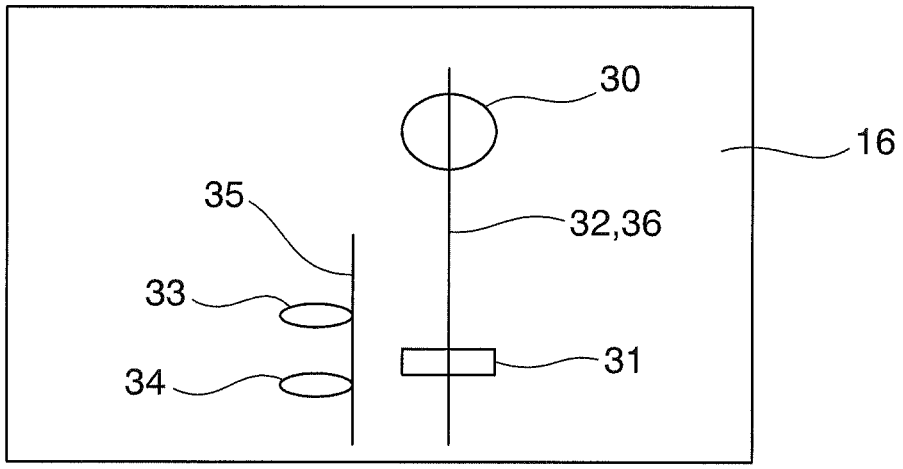
FIG. 9 is a diagram of display showing whether or not a direction is correctly set with respect to a putting line based on a hole image, a face, and an image of toes of both feet.

FIG. 9 is a diagram showing a left foot image 33, a right foot image 34, and a stance direction line 35 which is a line connecting the toes of both feet as well as the hole image 30, the putter head image 31, and the guideline 36 (face perpendicular line 32), and it is possible to check whether or not the stance direction line 35 is parallel to the guideline 36, namely whether or not the person who practices stands with his/her stance in a preferable stance state.

Figure 10:
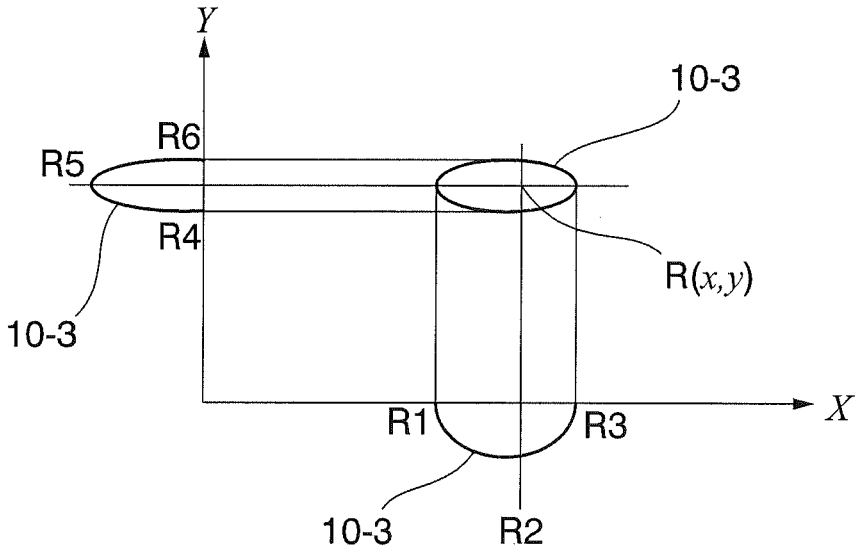
FIG. 10 is a schematic diagram of shadow projection in an X-Y direction for performing image processing at the time of imaging a hole.

FIG. 10 is a schematic diagram of projection in an X-Y direction for performing image processing at the time of imaging the hole. 10-3 represents the hole at the time of imaging, R (x, y) is center coordinates of the hole, 10-1 represents projection in the Y direction, 10-2 represents projection in the X direction, and R1, R2, and R3 are points at the time of projection to an x axis, where R2 is the middle point though seems to be deviated therefrom. In the same manner, the points with respect to the Y axis are represented as R4, R5, and R6.

Figure 11:
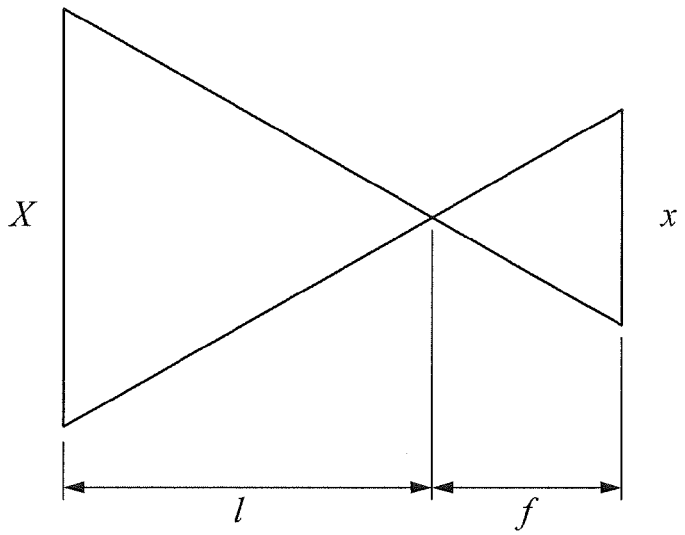
FIG. 11 is an explanatory diagram for calculating a distance up to a hole from an image size shown in an image sensor (CCD) of a camera with the use of a fact that the hole size is fixed.

FIG. 11 is an explanatory diagram for calculating a distance up to the hole based on an image size shown in the image sensor of the camera with the use of the fact that the hole size is fixed. X (a capital X) represents a diameter of the hole, and x (a small letter x) represents a size (the number of pixels) captured by the image sensor. 1 (a small letter 1) represents a distance from a lens of the camera to the hole, and f (a small letter f represents a focal length of the camera lens. Thus, it is possible to automatically calculate the distance up to the hole.

Figure 12:
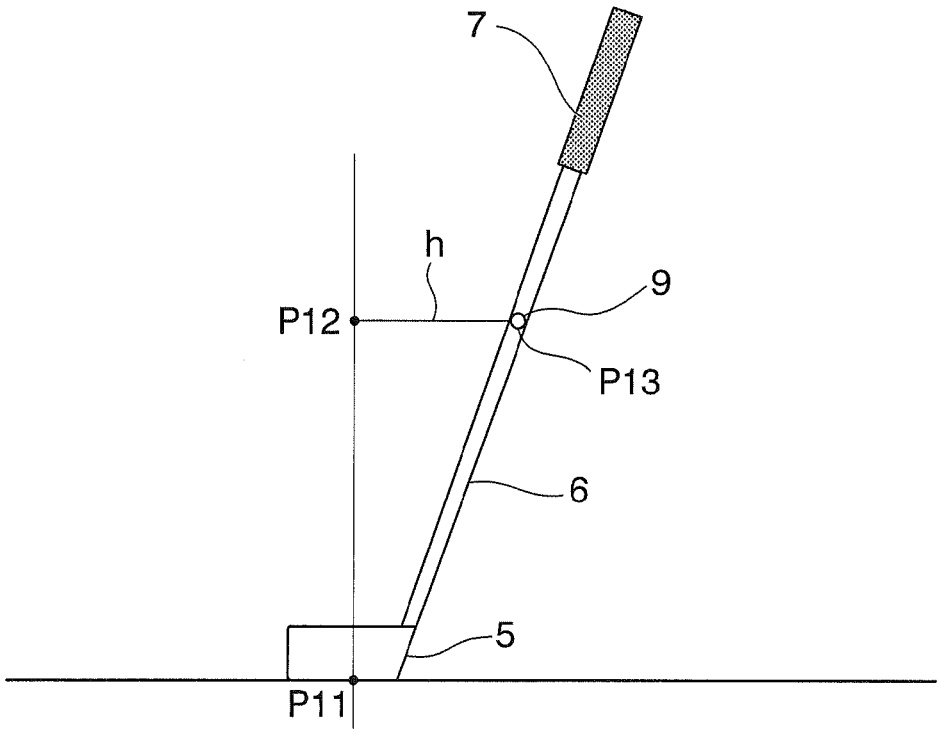
FIG. 12 is a diagram for illustrating a correction method for imaged data as a distance between camera mounting positions in a vertical direction.

FIG. 12 is a diagram for illustrating a correction method of imaged data which is a distance between camera mounting positions in the vertical direction. P11 represents a center of a bottom portion (origin) of the putter head 5, P13 is a mounting position of the first camera 9, P12 represents an intersection with a perpendicular line drawn from the P13 to the vertical line drawn from P11 (a point corresponding to height, at which the first camera 9 is mounted, which is measured in a vertical direction), and h represents a distance from P13 to P12.

Figure 13:
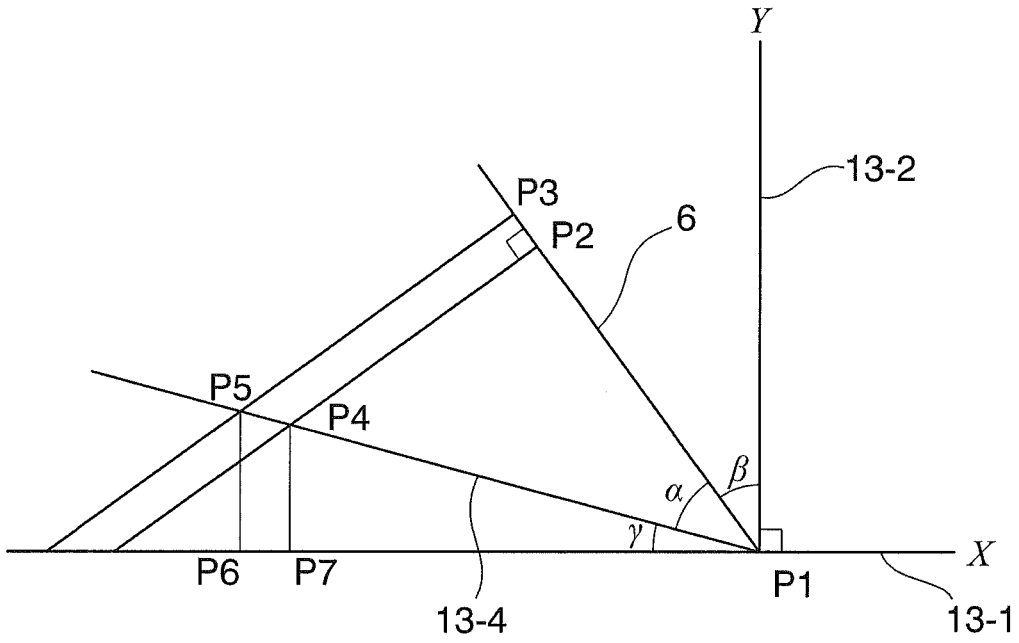
FIG. 13 is an explanatory diagram for calculating an actual distance.

FIG. 13 is an explanatory diagram for calculating an actual distance. 13-1 represents an X axis (X-Y coordinates), 13-2 represents a Y axis (X-Y coordinates), a reference numeral 6 represents the shaft, 13-4 represents the green, P1 represents a ground point between the lower part of the shaft 6 and the green, P2 represents a mounting position of the distance sensor 19, P3 represents a mounting position of a first camera 9, P4 represents a distance from the distance sensor 19 to a measurement point on the green, P5 represents a hole position, P6 represents an intersection with a perpendicular line from P5 to the X axis, P7 represents an intersection with a perpendicular line from P4 to the X axis, α represents an angle between the shaft 6 and the green, β represents a leaning of the shaft 6 from the Y axis, and γ represents a gradient of the green from a horizontal surface (X axis) (to-horizontal-surface angle between a straight line connecting the hole and the center of the putter head and the horizontal surface).

Figure 14:
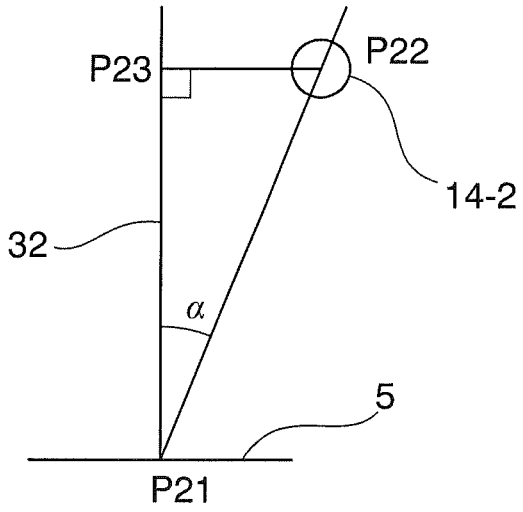
FIG. 14 is a diagram for calculating a deviation between a face of a putter and a hole.

FIG. 14 is a diagram for calculating a deviation angle α1 between the face perpendicular line 32 and the hole center. P21 represents a putter head center point, P22 represents a hole position, P23 is an intersection between a perpendicular line drawn from P22 to the face perpendicular line 32 and the face perpendicular line 32, a reference numeral 5 represents the putter head (face 4), and 14-2 represents the hole.

Figure 15:
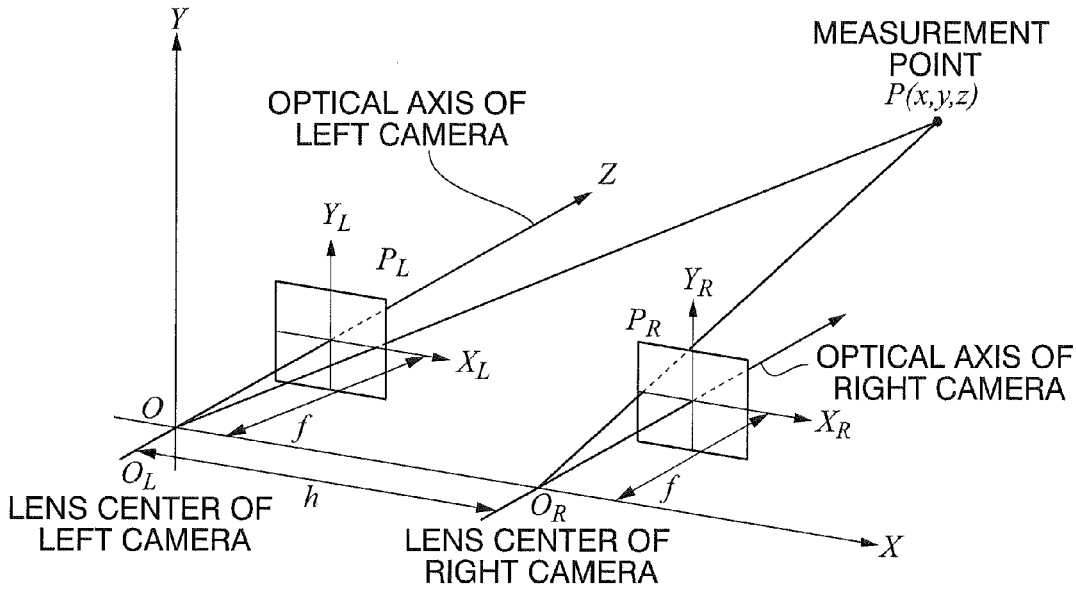
FIG. 15 is an explanatory diagram of triangulation with the use of two cameras.

FIG. 15 is an explanatory diagram of triangulation with the use of two cameras.

Figure 16:
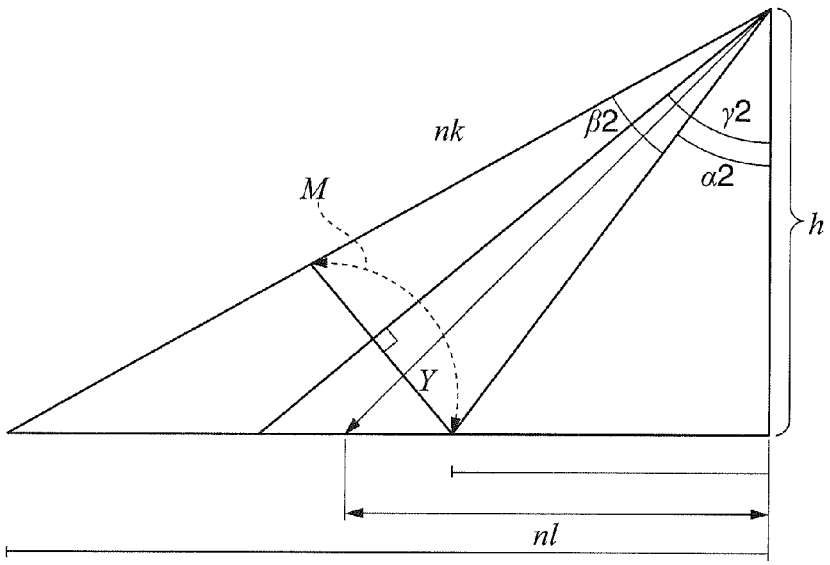
FIG. 16 is an explanatory diagram for calculating a position imaged by an image sensor in accordance with the distance up to a hole.

FIG. 16 is an explanatory diagram for calculating the distance from the putter head position to the hole imaged by the image sensor.

α2 represents an angle of an imaged lowermost part, β2 represents a field angle (view angle) in imaging by the camera, γ2 represents a camera mounting angle which is α2+β2/2, h represents a camera mounting position (height from the bottom surface of the putter head 5), M represents a number of pixels in the vertical direction (the number of pixels), nl represents a distance from a position on a green imaged at an arbitrary pixel position in the vertical direction to the putter head 5, y represents a pixel position in the vertical direction, which is captured when an object at the position nl is imaged (the number of pixels), and nk represents the distance from a position on the green imaged at an arbitrary pixel position in the vertical direction to the image sensor.

Figure 17:
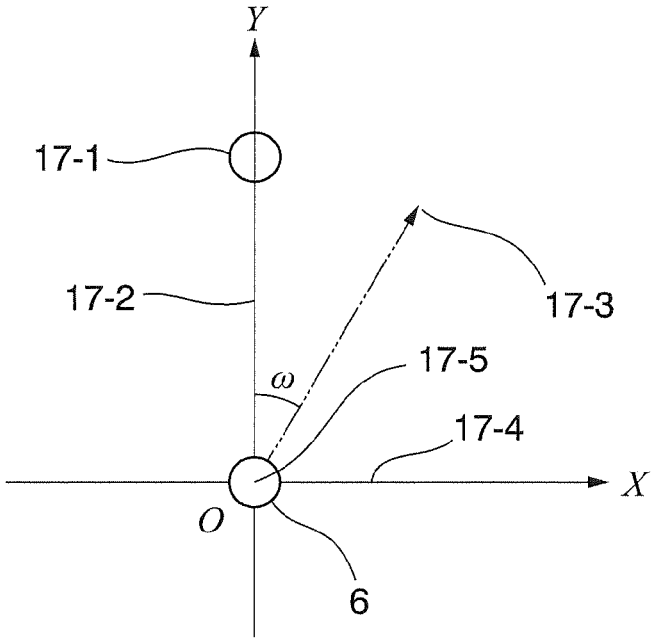
FIG. 17 is a diagram of a putter viewed from above for illustrating a rotation angle.

FIG. 17 is a diagram of the training putter 2 viewed from above for illustrating a rotation angle. 17-1 represents the hole, 17-2 represents the Y axis in the X-Y coordinates, 17-3 represents a measurement point, 17-4 represents the X axis in the X-Y coordinates, 17-5 represents a position of the distance sensor 19 after the rotation, and a reference numeral 6 represents the shaft, and ω represents a rotation angle (orientation angle) on the basis of the Y axis.

Figure 18:
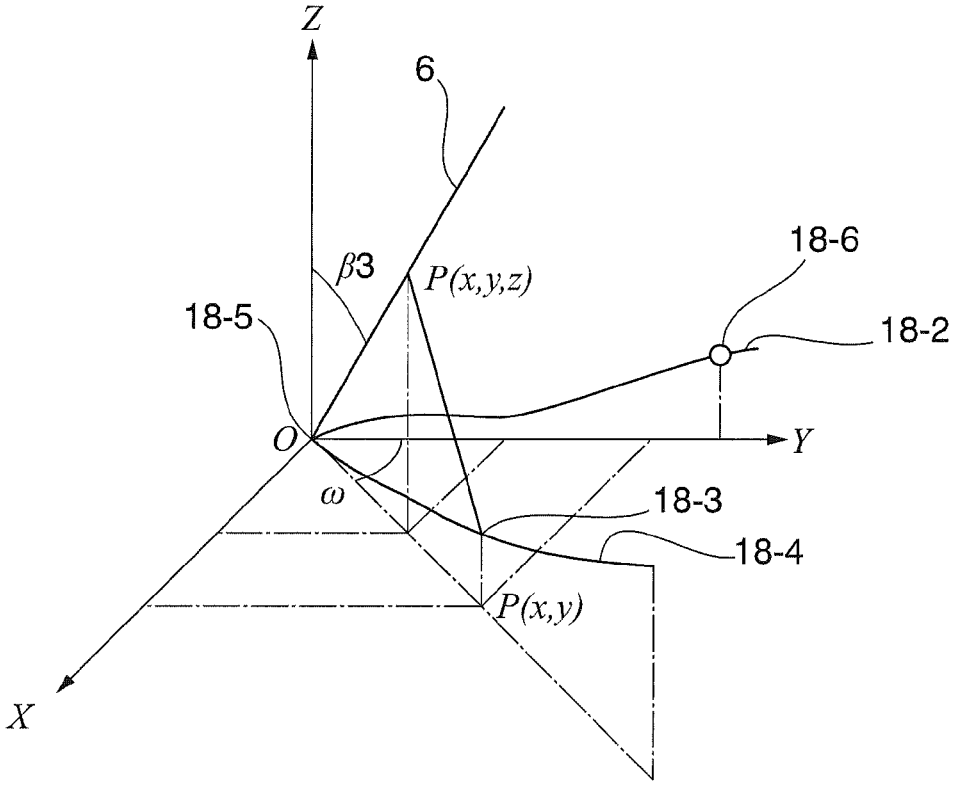
FIG. 18 is a diagram for illustrating undulation on a green with three-dimensional coordinates.

FIG. 18 is a diagram for illustrating undulation on the green in a three-dimensional coordinates. A reference numeral 61 represents the shaft, 18-2 represents the green, 18-3 (x, y, z) represents a measurement point, 18-4 represents the green, 18-5 represents a bottom surface (origin) of the putter head, X represents the X axis, Y represents the Y axis, Z represents the Z axis, β3 represents the club inclination angle, ω represents the club rotation angle, and P (X, Y) represents coordinates of a measurement point in the XY plane.

Figure 19:
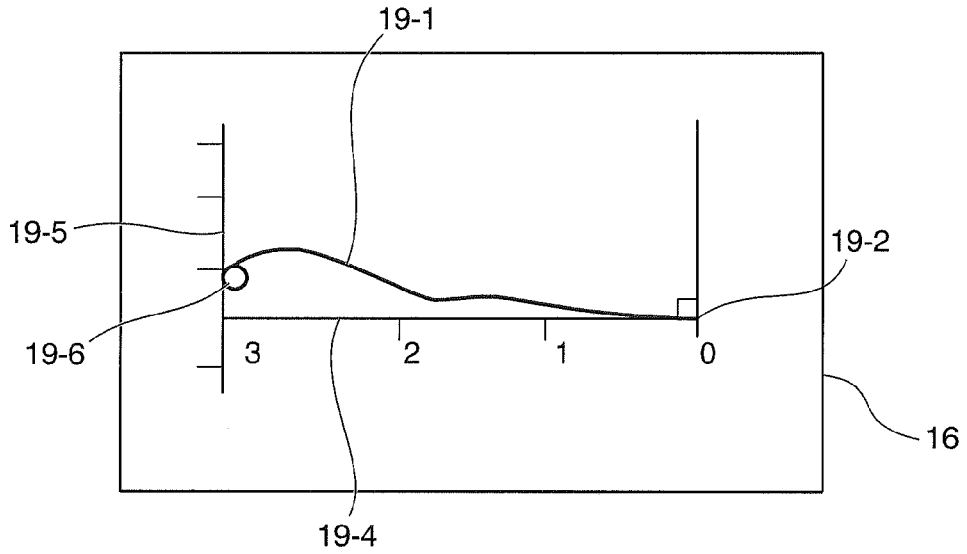
FIG. 19 is a diagram in which undulation from a putter head position (ball position) to a hole is displayed in section.

FIG. 19 is a diagram in which undulation from the putter head position (ball position) to the hole is displayed in section. 19-1 represents a cross-sectional view of the undulation on the green from the putter head position (ball position) to the hole, 19-2 represents the head position (ball position), a reference numeral 16 represents a surface liquid crystal display, 19-4 represents a Y axis on the basis of the putter head position, 19-5 represents a Z axis on the basis of the putter head position, 19-6 represents the hole position, and 0, 1, 2, and 3 here represent examples of unit distances as example.

Figure 20:
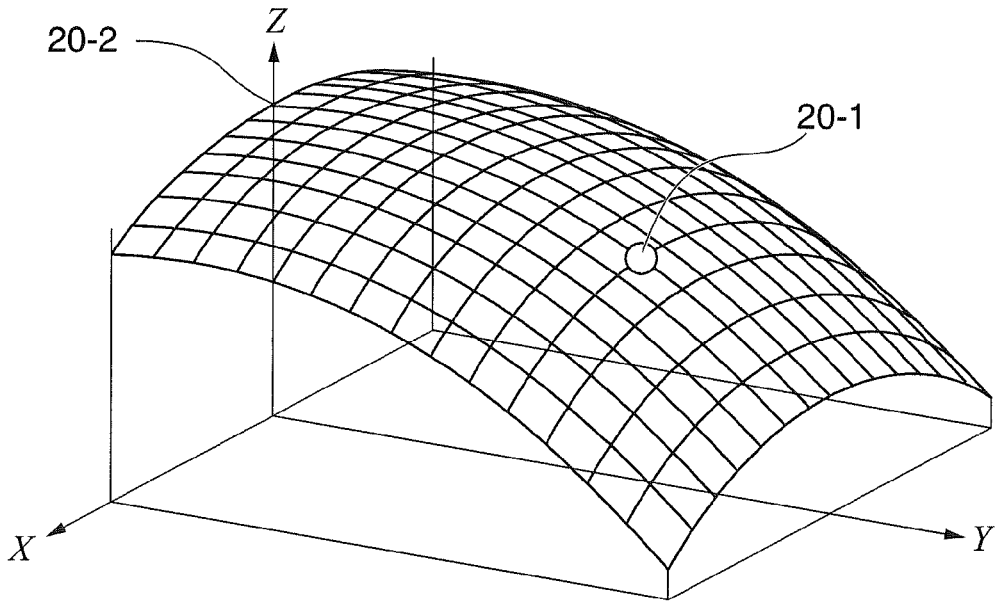
FIG. 20 shows an example in which undulation is displayed in a three-dimensional manner.

FIG. 20 is an example in which undulation is displayed in a three-dimensional manner. 20-2 represents an origin (which corresponds to both the putter head position and the ball position).

According to the present invention, combinations with various devices are important. Particularly, a camera (for example, manufactured by Alsps Electric Co., Ltd: (product number FPDJ8)), a distance meter (distance sensor: manufactured by Efector Co., Ltd.: O1D104), an accelerometer (for example, manufactured by Hitachi Metals, Ltd: H48C; an acceleration manufactured by Bosch is also applicable), an inclination sensor (for example, manufactured by Hitachi Metals, Ltd: H48C; the same as the preceding item), a gyro sensor (manufactured by Epson Toyocom Corporation, XV-8000LK), and a geomagnetic sensor (manufactured by Hitachi Metals, Ltd.: HM55B; manufactured by Honeywell: HMC6352; manufactured by Yamaha Corporation: YAS529) for detecting a rotation angle are preferably used. A power source unit may be attached to the putter head or the grip.

A configuration is also applicable in which a notification unit 24 is included for a notification with sound when the hole and the face direction coincide with each other.

Example 1

First, an ordinary putter for golf was prepared as the putter 3. Batteries (two AAA batteries) as the power source unit, a switch unit (first switch 14) for turning on and off the power source, a function switch (second switch 15), a third camera (downward-pointing) which captures the putter face and the positions of both feet (toes or the like) in taking a stance at the time of putting address with a camera manufactured by Alps Electric Co., Ltd. (model number FPDJ8) (size: 1.496 mm*1.056 mm; number of pixels: 640 (H)*480 (V); field angle (horizontal: 54.7 deg*vertical 42.3 deg); focal length: 1.37 mm; pixel size: 2.2 μm*2.2 μm; frame frequency: 30 fps), an image memory unit thereof, a computation unit which simultaneously performs computation, a display unit (also referred to as a monitor unit; a liquid crystal display) which displays a result, a computation unit and an image-capturing unit which captures the hole with a first camera and a second camera manufactured by the same company and computes a distance and a direction, a distance meter (distance sensor: manufactured by Efector Co., Ltd.: O1D104), an accelerometer (manufactured by Hitachi Metals, Ltd.: H48C), an inclination sensor (manufactured by Hitachi Metals, Ltd.: H48C), a gyro sensor (manufactured by Epson Toyocom Corporation: XV-8000LK), and a geomagnetic sensor (manufactured by Honeywell: HMC6352) for detecting a rotation angle were prepared.

An inclination sensor for measuring the leaning of the club (putter), the geomagnetic sensor for detecting the rotation angle of the club (putter), the computation unit which computes and displays a shot direction, and a display unit (manufactured by Seiko Instruments Inc.) showing a result thereof were prepared.

The power source unit (not shown) was provided in the putter head 5. The first switch 14 was attached to a lower portion of the grip 7. The first switch 14 had a function of turning on the power and was configured as a shift switch of the camera after the power was on.

The computation unit which calculated the distance and the inclination angle from the ball to the hole based on the following calculation method (Calculation Method 1) and the display unit (monitor unit) which displayed the inclination angle calculated as a planar slope while slight undulation was ignored and a direction in which the ball should be hit were provided right under the grip (on the side of the head direction).

A display image was configured to be switchable with the switch unit. The first camera 9 was mounted at height of 55 cm from the putter head 5, the second camera 10 was mounted at height of 62 cm, and that is, the two cameras were attached to the shaft 6 in the extending direction at an interval of 7 cm.

The third camera 11 which captures the feet of the person who practices was attached at a height of 50 cm from the putter head 5. The external dimensions of the camera were set to about 5 mm×5 mm×2.2 mm. The distance sensor 19 was attached at a height of 60 cm from the putter head 5. The distance sensor 19 was attached so as to be parallel to both optical axes of the first camera 9 and the second camera 10.

Computation functions were made to concentrate at the computation unit, and display functions were made to concentrate at the display unit. The display unit (liquid crystal display 16) was configured as an openable type according to which the display unit was provided and opened as a cover on the surface side of the computation unit and an image was displayed when the display unit was opened.

It is a matter of course that the liquid crystal display was configured to be opened in a direction in which the liquid crystal display could easily be seen when the person who practiced held the putter and looked down the ball. A displayed image which displays the shot direction and the inclination angle (and the shot speed, if necessary) was configured to be shifted with the switch unit.

A substrate is provided at a surface facing the display unit (monitor), and the image memory, the CPU, the accelerometer (manufactured by Epson Toyocom: XV-3500CB], the geomagnetic sensor (manufactured by Honeywell: HMC6352), the inclination sensor (manufactured by Hitachi Metals, Ltd.: H48C) were mounted such that the angle of the inclination sensor at the time of the inclination toward the face 4 was expressed as a + direction while the vertical direction was set to 0°. The distance sensor (manufactured by Efector Co., Ltd.: O1D104) was also mounted at the same position.

With the above equipment, the hole was firstly targeted, the direction was set, and the hole direction (dotted line) and the direction in which the person who practiced took a stance (solid line) were then displayed as shown in FIG. 6 for a deviation from the hole direction.

Next, when the hole was matched with a reference line, which was shown as 7-2 in FIG. 7, displayed on the monitor, a distance (the length of a line segment P2-P4) shown in FIG. 13 was measured by the distance sensor 19, the angle β was measured by the inclination sensor 20, and it was possible to know misalignment of the direction of the face 4 before the putting. In addition, it was also possible to know the distance up to the hole and the gradient in advance.

Calculation Method 1 in Example 1

In order to determine a deviation between the targeted direction and the hole direction (display the directions on the monitor) or automatically recognize that the hole is on the reference line, prior to the calculation, image processing for specifying the hole position from the captured image was performed. Although an RGB color space, a CMY color space, an HLS color space, a YCC color space, and the like are generally known, an RGB color space was used here.

(1) In order to determine a threshold value for binarization, color strength conversion (level conversion) was performed. In order to perform the color strength conversion (level conversion), a color strength value histogram (histogram) which is well known in image processing was created.

(2) As a method for determining the threshold value, a mode method was employed to determine the threshold value, and binarization processing was executed (another well-known method such as a percentile method or a differential histogram method may also be used). That is, this is for differentiating a color (a white paint color, a color of soil: a yellow ocher color) of the hole (cup) and a color (green) of the green.

(3) In order to remove noise, expansion processing was executed.

(4) Projection (shadow projection) was respectively performed in the X axis and Y axis directions, and the hole position (coordinates) were specified. That is, if the description is given with reference to FIG. 10, peak of the color strength value (R2 in the X axis direction, and R5 in the Y axis direction) after the shadow projection in the X axis and Y axis directions, a continuous distance (it is assumed that R1-R3=1x represents the distance in the X axis direction and R4-R6=1y represents the distance in the Y axis direction), an area (it is assumed that S x represents a part surrounded by the X axis, R1, R2, and R3 for the X axis direction and Sy represents a part surrounded by the Y axis, R4, R5, and R6) were obtained, a gravity center in each axial direction was obtained as coordinates R (x, y) of the X and Y axes.

A peak value R5 of the Y axis was compared with (the longer diameter) 1x, and the peak value R2 of the X axis was compared with a (smaller diameter) value of 1y (which is determined to be correct when the comparison result was equal to or less than 10%) to confirm that an object was the cup (which is imaged as an ellipse), and at the same time, the size (the number of pixels) imaged by the image sensor was calculated from the distance from the camera to the cup, the size was compared with the actual imaged size, and it was determined whether or not the calculated value was an appropriate value to determine the object was a cup (false recognition of a marker, a ball, or the like is prevented).

Next, the equations used will be shown. In FIG. 11, if it is assumed that X represents the size of the object, x represents the size imaged by an imaging element of the camera, f represents the focal length, 1 (small letter 1) represents the distance from the object to the lens, and p represents the pixel size of the imaging element (image sensor) of the cameral which satisfies x=X (f/1) from 1:f=X:x, and a number of pixels (dot) imaged by the image sensor is obtained from this, dot=x/p is satisfied, and if a focal length and a pixel size used this time are substituted, focal length f=1.37 mm=1.37×10−3 m, the pixel size p=2.2 μm=2.2×10−6 m, and cup size X=10.8 cm=1.08×10−1 m are obtained. If it is assumed that d represents the distance up to the cup (between objects), the number of pixels (dot) imaged by the image sensor is: dot=(1.08×1.37×102)/(2.2×d).

The calculation was also performed from the imaging field angle of the camera this time, and the validity of the both calculation methods were compared.

((d×tan α/2)×2)×cup size/number of pixels in the horizontal direction (number of pixels in the horizontal direction: total number of pixels in one line in the horizontal direction).

(5) Description will be given of a correction method of the head center and the camera mounting position with the use of FIG. 12. If it is assumed that P11 (which is set to an origin) represents a center of a bottom portion of the putter head 5, h=|P2-P3| represents a distance from P13 as a mounting position of the first camera 9 to P12, and x represents coordinates of the camera position, a new coordinate x becomes x=x-h, provided that a reference of the coordinates is coordinates of the cup position.

About the mode method and the shadow projection (projection) used in the image processing, "Guide to Computer-aided Image Processing" complied under the supervision of Hideyuki Tamura (Sohken Publishing Co., Ltd., Jun. 1, 1986, First edition, Third Printing) pp. 110-113 (Non-Patent Document 3) and "Guide to Digital Image Processing" written by Koichi Sakai (CQ Publishing Co., Ltd., Oct. 1, 2002) pp. 63-68 (Non-Patent Document 4) will be cited, and a description thereof will be given here.

The mode method is a method in which when a difference in color strength between a target figure and a background is large and a clear turning point is generated in the histogram, a position of the turning point is set to a threshold value (from Non-Patent Document 4). Generally, projection of an image onto a certain axis means that color strength of pixels in a line in a direction perpendicular to the axis is successively summed up and the sum is obtained. By repeating this operation while the position of the straight line is moved little by little in a parallel direction, a line of the sum of the color strength (one-dimensional waveform) can be obtained. This waveform is called a projection of the image onto the axis.

As shown in FIG. 10, if it is assumed that P (i,j) represents color strength of each element in a matrix P of an image of n*m, the shadow projection is given by:

$$Px(i) = \sum_{j=0}^{m-1} P(i, j) \quad 0 \le i \le n-1,$$

$$Py(j) = \sum_{i=0}^{n-1} P(i, j) \quad 0 \le j \le n-1$$

as the projection of the color strength to each of the x axis and the y axis (from Non-patent Document 3).

In FIG. 13, if it is assumed that a=|P1-P2|, a1=|P1-P3|, b=|P2-P4|, c=|P1-P5|, the distance and the gradient between the ball and the cup are automatically calculated from values of a, a1, b, and β. The distance and the gradient are as follows: Since $\alpha=\tan^{-1}(b/a)$, the distance c satisfies $$c=a1/\cos\alpha \qquad \text{Equation 1-1.}$$

As for the gradient γ, $$\gamma=\pi/2-(\alpha+\beta) \qquad \text{Equation 1-2.}$$

A unit of an angle is radian.

Example 2

In order to measure the gradient and the undulation up to the ball with the use of the training putter 2 completed as above, an undulation creation mode was set by pressing the second switch 15, and the hole was firstly captured on the reference line (displayed with a marker). If the description is given with reference to FIG. 17, the hole position is 17-1, and the inclination angles, the distances, and the orientation angles before and after the club were measured, and coordinates were calculated. This will be expressed as Pc (x, y, z).

When the measurement of the hole position Pc was completed, completion of the measurement was displayed on the monitor. Then, in order to accumulate measurement data of a plane from the putter head 5 to the hole, the putter head 5 was shaken from front to back and from side to side or rotated (scanned) from side to side in a state in which the putter head 5 was grounded, data (the inclination angle before and after the club, the distance, and the orientation angle) was accumulated at a predetermined interval (1/30 seconds) (or the plane may be scanned with the use of a drive system (motor or the like). 17-3 in FIG. 17 represents each of the measurement points.

At the time of completion of the data accumulation, the second switch 16 was pressed again. As one of approximations for analyzing and displaying the data, neighborhood was approximated and coupled with a curve (including a straight line) such that a sequential space (three dimensions) is obtained from each point (x, y, z) of the accumulated data. That is, the inventor expressed this as an application of "mathematical" correction. Accordingly, the guideline was obtained as a curve. A surprisingly correct guideline could be obtained. As for the display, the both were displayed. This was on the assumption of a completely flat slope.

Calculation Method 1 in Example 2

As shown in FIG. 19, in order to display undulation of a line cross section up to the hole position while the center of the putter head 5 was set to an origin, the following equations were used to calculate the coordinates of the hole position and the coordinates of each measurement point from the position of the putter head 5 (which is the same as the ball position) to the hole position.

If the coordinates of the position of the putter head 5 (the ball position) is assumed to be 0 (0, 0, 0), x of the coordinate Pc (x, y, z) of the hole position is assumed to be 0. y and z were obtained as follows from γ and c obtained in FIG. 13 and Example 1.

$$x=0$$

$$y=c\cdot\cos\gamma$$

$$z=c\cdot\sin\gamma.$$

In the graph of FIG. 19, each of (adjacent) points were approximated with a straight line.

In addition, a calculation method using the mounting position of the distance sensor 19 instead of the marker position as a coordinate value of each measurement point is also applicable. That is, a (a line segment P1-P2 in FIG. 13) instead of a1 (a line segment P1-P3 in FIG. 13) in Equation 1-1 is used as c, and c=a/cos α . . . Equation 2-1 is obtained.

$$x=0$$

$$y=c\cdot\cos\gamma$$

$$z=c\cdot\sin\gamma$$

are also applicable.

Calculation Method 2 in Example 2

The undulation display on the green up to the hole position may be expressed by a graph, as shown in FIG. 20, while the center of the putter head was set to be the origin. The coordinates of the measurement point was calculated from the inclination before and after the club, and the rotation in the horizontal direction, namely the rotation angle. Since the geomagnetic sensor 21 was used as the rotation angle sensor, an orientation angle was obtained as a measurement value. In order to use this orientation angle as the rotation angle, the hole direction was relatively set to zero to obtain a rotation angle. That is, when it is assumed that ω0 represents the orientation angle in the hole direction and ω1 represents the orientation angle at the time of rotation, the rotation angle at the time of rotation is expressed as ω1−ω0. First, in relation to the coordinates of the hole position, if the coordinates of the putter head position (ball position) is set to be 0 (0, 0, 0) in the same manner as in "Calculation Method 1 in Example 2", the coordinates Pc (x, y, z) of the hole position become the following:

$$x=0$$

$$y=c\cdot\cos\gamma$$

$$z=c\cdot\sin\gamma.$$

Here, c is the same as that obtained in Equation 1-1, and γ is the value obtained by Equation 1-2.

Next, coordinates of each measurement point was calculated. If it is assumed in FIG. 13 that a represents length of a line segment P1-P2 and b represents length of a line segment P2-P4, $$P1-P4=\sqrt{(a^2+b^2)}$$

is obtained, and then:

$$P1-P7=\sqrt{(a^2+b^2)}\cdot\cos\gamma$$

is obtained. Since OP (length of a line segment O−P) in FIG. 18 is equal to P1-P17 in FIG. 13, a point P in the X-Y plane coordinates in FIG. 18 can be calculated as follows. Here, ω represents a club rotation angle in FIG. 17 and FIG. 18. Since OP=P1-P7 is satisfied, the coordinates P (x, y) of the point P in the plane coordinates in FIG. 18 become:

$$x=OP\cdot\cos(\pi/2-\omega)$$

$$y=OP\cdot\sin(\pi/2-\omega),$$

z becomes PP4−P7 as shown in FIG. 13, and $$z=c\cdot\sin\gamma$$

is obtained.

Here, c is the same as that obtained by Equation 2-1, γ is γ in FIG. 13 which is the same as that obtained by Equation 1-2. Based on the above equations, three-dimensional coordinates could be calculated. Next, coordinate data at intervals of unit distance were interpolated (linearly approximated) with adjacent data to create a three-dimensional graph from coordinates of adjacent points, and three-dimensional coordinate data were created. Finally, adjacent points (coordinates) were approximated with a straight line, and a three-dimensional graph was created. A display example will be shown in FIG. 20.

Example 3

The distance from the center of the putter head to the hole was calculated based on the hole position imaged by an image memory (image sensor) instead of the distance meter in Example 1. In FIG. 16, if it is assumed that α represents a minimum angle (field angle zero position), β represents a camera imaging field angle (view angle), γ represents a camera mounting angle, h represents a camera mounting position (height) M represents a number of pixels in one line in the vertical direction of the image sensor, and y represents the position (center) of the hole (object) imaged by the image sensor, the distance nl (nl in FIG. 16) up to the hole is expressed as:

$$\alpha=\gamma-\beta/2$$

$$n1=h\cdot\tan((y\cdot\beta)/M+\alpha).$$

In addition, if the distance (nk in FIG. 16) from the camera position is calculated from nl, and $$nk=\sqrt{(nl^2+h^2)}$$

is obtained.

With the above equipment, it was possible to know misalignment of the putter face in Example 1, Example 2, and Example 3 regardless of a down line. Since the distance was known, the size of the backswing was known. Since the gradient was known, it was possible to know a visual trick beforehand.

Example 4

Triangulation was used instead of the distance meter in Example 1, Example 2, and Example 3. With the above equipment, it was possible to know the misalignment of the putter face before hitting regardless of an uphill line. Since the distance was known, the size of backswing was known. Since the gradient was known, it was possible to know a visual trick beforehand.

It is also substantially preferable that a plurality of cameras is provided. On this occasion, if the following definition is made, it is possible to calculate a subsequent equation and mount the equation on the program of the computation unit.

In FIG. 15, X represents an X axis, Y represents a Y axis, and Z represents a Z axis in space coordinates, and lens centers of the left camera and the right camera were respectively at points $O_L$ and $O_R$ separated from each other by a distance h2. It is assumed that coordinates of the point $P_L$ obtained by projecting the point P in an $X_LY_L$ local coordinate system is $P_L$, namely ($x_L$, $y_L$), in a left image obtained by imaging the point P (x, y, z), and coordinates of the projection point $P_R$ of the point P in the $X_RX_R$ local coordinate system is $P_{R,\ namely}$ ($x_R$,$y_R$) in the right image. In addition, it is assumed that f represents the focal length of the camera.

At this time, the coordinate value of the point P (x, y, z) is calculated by the following equation.

$$x=(x_L\cdot h)/(x_L-x_R)$$

$$y=(y_L\cdot h)/(x_L-x_R)=(y_R\cdot h)/(x_L-x_R)$$

$$z=(f\cdot h)/(x_L-x_R)$$

A method based on a calculation method shown in "Image Processing and Recognition" written by Takeshi Agui et al (Shoko-do Co., Ltd., Sep. 30, 2004, first edition, sixteenth printing) pp. 140-157 (Non-Patent Document 2) as a program or an LSI is preferably used as the "computation unit".

Example 5

First, an ordinary "putter" for golf was prepared. Moreover, the following components were prepared. That is, a battery unit, batteries (two AAA batteries), a switch unit (SW1) with which the power is turned on and off, a camera (image sensor) capturing (imaging) the hole, which was manufactured by Alps Electric Co., Ltd.: (product number: FPDJ8) (size: 1.496 mm*1.056 mm; number of pixels: 640 (H)*480 (V); field angle (horizontal: 54.7 deg*vertical 42.3 deg); focal length: 1.37 mm; pixel size: 2.2 μm*2.2 μm; frame frequency 30 fps) were used.

The image memory unit, the computation unit which simultaneously computes the distance and the direction, and the display unit (lamp type display device 17 shown in FIG. 8) were prepared.

The battery unit was provided at the head. The switch (SW1) was attached to the lower portion of the grip.

The camera was provided inside the shaft at a height position of 62 cm from the lower portion of the putter head. The horizontal direction of the camera was set to be parallel to the putter head face, and the camera was attached such that the mounting direction in the vertical direction became 52° downward from the perpendicular line in the shaft direction. The display unit was mounted on the upper portion of the putter head.

The lamp (LEDs) of the display unit are mounted at the same position as the positions of the image memory and the CPU on the front surface side of the computation unit and the rear surface of the substrate of the display unit (monitor).

The display unit in Example 5 will be shown in FIG. 8. The computations for obtaining the position and the size (or the number of pixels) of the hole was performed in the same manner as in Example 1, Example 2, Example 3, and Example 4.

For the display of a deviation, the size of the hole was firstly calculated as shown in FIG. 10, the deviation amount (length of a line segment P22-P23) from the hole position (P22) shown in FIG. 14 was obtained, and the lamps corresponding to the deviation amount were turned on. In so doing, it was possible to obviously know a difference between the stance direction and the correct direction.

Example 6

In Example 6, the hole position, the face direction, and the positions of both feet (toes) at the time of address were measured in the same manner as in Example 1, Example 2, and Example 3, and a direction connecting the toes of both feet was approximated with a straight line and then displayed as shown in FIG. 9. A direction of the face was also expressed as a straight line at the same time. In so doing, it was possible to easily know a difference between the face direction at the time of the address and the positions of the both feet (toes). If the hole cannot be seen, there is no way for the camera, the laser distance meter, or the ultrasonic distance meter to perform. However, it is possible to obtain the distance and the direction by adding the gyro censor 23 if the hole can be seen when the club is made to stand at a predetermined dimension located immediately above the ball position in order to overcome the situation.

It should be noted that a golf training putter having a camera which is characterized by including a computation unit which computes a distance from data from a laser distance meter, an ultrasonic distance meter, or one or a plurality of cameras, including a display unit which displays the distance up to the hole, and further including the gyro sensor 23 is also included in the present invention.

It is also preferable that height data of each component at the time of holding a club (putter) over a head is input to the computation unit. Calculation of triangulation has been known. By using the gyro sensor 23 and the triangulation as described above, it is possible to obtain the distance and the direction up to the hole even in the case in which it is not possible to image the hole with the camera attached to the shaft 6.

Specifically, the present invention can be used by a golf player for practicing puttering. The present invention can be used for correcting the bad habits of a player. In addition, the present invention is preferably used by an organizer of a golf game for providing a hole at a position where a visual trick easily occurs. The present invention can also be used for creating a so-called challenging course. As a result, the present invention can greatly contribute to the golf instrument industry.

What is claimed is:

1. An image-capturing apparatus for putting practice which is mounted on a putter provided with a head including a face for putting, a shaft, and a grip, the image-capturing apparatus comprising:

an image-capturing unit provided with a camera for imaging a hole;

a computation unit configured to specify a face perpendicular line which is a vertical line drawn from a center of the face, and calculate a relative relation between the hole and the face perpendicular line based on a hole image captured by the camera;

a display unit configured to display the relative relation calculated by the computation unit; and a mounting unit configured to mount at least the image-capturing unit on the shaft or the grip;

wherein the display unit is provided with a plurality of lamps which are turned on in accordance with a deviation amount between the hole and the face perpendicular line.

2. The image-capturing apparatus for putting practice according to claim 1, wherein the display unit is provided with a display configured to simultaneously display the hole and the face perpendicular line.

3. The image-capturing apparatus for putting practice according to claim 1, wherein the computation unit calculates a distance from the face to the hole based on the longer diameter of the hole image, and the display unit displays the distance.

4. The image-capturing apparatus for putting practice according to claim 1, wherein the image-capturing unit is provided with a second camera configured to capture the hole, and the computation unit calculates a distance from the face to the hole based on a disparity between two hole images captured by the camera and the second camera, and the display unit displays the distance.

5. The image-capturing apparatus for putting practice according to claim 1, wherein the computation unit calculates an angle between a straight line connecting the hole and a center of the head and the face perpendicular line, and the display unit displays the angle.

6. The image-capturing apparatus for putting practice according to claim 1, further comprising a shot sensor configured to detect putting by the face, wherein the computation unit calculates a relative relation between the hole and the face perpendicular line at the time of the shot detected by the shot sensor, and the display unit displays the relative relation at the time of the shot calculated by the computation unit.

7. The image-capturing apparatus for putting practice according to claim 1, further comprising a notification unit configured to generate sound or vibration in accordance with the relative relation calculated by the computation unit.

8. A training putter comprising the image-capturing apparatus for putting practice according to claim 1.

9. The training putter according to claim 8, wherein the image-capturing unit is mounted at a position, which is closer to the grip than an intermediate point between the head and the grip, in the shaft.

10. An image-capturing apparatus for putting practice which is mounted on a putter provided with a head including a face for putting, a shaft, and a grip, the image-capturing apparatus comprising:

an image-capturing unit provided with a camera for imaging a hole;

a computation unit configured to specify a face perpendicular line which is a vertical line drawn from a center of the face, and calculate a relative relation between the hole and the face perpendicular line based on a hole image captured by the camera;

a display unit configured to display the relative relation calculated by the computation unit; and a mounting unit configured to mount at least the image-capturing unit on the shaft or the grip;

wherein the image-capturing unit is provided with a downward-pointing camera configured to capture the feet of a person who practices, and wherein the computation unit specifies a stance direction of the person who practices based on an image captured by the down-pointing camera, and the display unit displays the stance direction as well as the relative relation.

11. An image-capturing apparatus for putting practice which is mounted on a putter provided with a head including a face for putting, a shaft, and a grip, the image-capturing apparatus comprising:

an image-capturing unit provided with a camera for imaging a hole;

a computation unit configured to specify a face perpendicular line which is a vertical line drawn from a center of the face, and calculate a relative relation between the hole and the face perpendicular line based on a hole image captured by the camera;

a display unit configured to display the relative relation calculated by the computation unit;

a mounting unit configured to mount at least the image-capturing unit on the shaft or the grip;

a distance sensor configured to measure a distance from the face to the hole; and an inclination sensor configured to measure the inclination of the putter, wherein the computation unit calculates a to-horizontal-surface angle between a straight line connecting the hole and a center of the head and a horizontal axis based on measurement results by the distance sensor and the inclination sensor.

12. The image-capturing apparatus for putting practice according to claim 11, wherein the display unit displays the to-horizontal-surface angle.

13. The image-capturing apparatus for putting practice according to claim 11, wherein the computation unit calculates a putting guideline from the face to the hole based on the angle, and the display unit displays the putting guideline with the face.

14. An image-capturing apparatus for putting practice which is mounted on a putter provided with a head including a face for putting, a shaft, and a grip, the image-capturing apparatus comprising:

an image-capturing unit provided with a camera for imaging a hole;

a computation unit configured to specify a face perpendicular line which is a vertical line drawn from a center of the face, and calculate a relative relation between the hole and the face perpendicular line based on a hole image captured by the camera;

a display unit configured to display the relative relation calculated by the computation unit;

a mounting unit configured to mount at least the image-capturing unit on the shaft or the grip;

a geomagnetic sensor configured to measure an orientation; and an inclination sensor configured to measure the inclination of the putter, wherein the computation unit calculates undulation from the face to the hole based on the plurality of hole images captured while the grip is moved from front to back and from side to side or rotated around the shaft in a state in which the head is grounded, and the display unit displays the undulation.

* * * * *